US008092562B2

(12) United States Patent
Sauer et al.

(10) Patent No.: US 8,092,562 B2
(45) Date of Patent: Jan. 10, 2012

(54) HOLDING PLATE FOR A VACUUM CLEANER FILTER BAG

(75) Inventors: Ralf Sauer, Overpelt (BE); Jan Schultink, Overpelt (BE)

(73) Assignee: Eurofilters Holding N.V., Overpelt (BE)

( * ) Notice: Subject to any disclaimer, the term of this patent is extended or adjusted under 35 U.S.C. 154(b) by 389 days.

(21) Appl. No.: 12/298,052

(22) PCT Filed: Apr. 23, 2007

(86) PCT No.: PCT/EP2007/003558

§ 371 (c)(1),
(2), (4) Date: Jun. 4, 2009

(87) PCT Pub. No.: WO2007/121979

PCT Pub. Date: Nov. 1, 2007

(65) Prior Publication Data

US 2009/0272083 A1 Nov. 5, 2009

(30) Foreign Application Priority Data

Apr. 25, 2006 (EP) ..... 06008560
Jan. 29, 2007 (DE) ..... 10 2007 004 329

(51) Int. Cl.
*B01D 46/02* (2006.01)

(52) U.S. Cl. ..... 55/367; 55/373; 55/376; 55/377; 55/378; 55/DIG. 2; 55/DIG. 3; 15/347

(58) Field of Classification Search ..... 55/361, 55/362, 367, 376, 369, 373, 377, 378, DIG. 2, 55/DIG. 3; 15/347, 350, 351, 352, 353
See application file for complete search history.

(56) References Cited

U.S. PATENT DOCUMENTS

| | | | | | |
|---|---|---|---|---|---|
| 2,975,862 | A * | 3/1961 | Goldberg | 55/376 |
| 3,237,846 | A * | 3/1966 | Brown | 55/361 |
| 3,283,481 | A * | 11/1966 | Studley et al. | 55/367 |
| 3,423,907 | A * | 1/1969 | Hughes | 55/367 |
| 3,432,997 | A * | 3/1969 | Baigue et al. | 55/367 |
| 3,495,386 | A * | 2/1970 | Bixler et al. | 55/367 |
| 3,803,815 | A * | 4/1974 | Anderson et al. | 55/367 |
| 7,468,083 | B2 * | 12/2008 | Davis et al. | 55/362 |

FOREIGN PATENT DOCUMENTS

| | | | |
|---|---|---|---|
| DE | 44 15 350 | A1 | 11/1995 |
| DE | 102 09 718 | A1 | 9/2003 |
| EP | 0 960 645 | A2 | 12/1999 |
| EP | 1 849 392 | A1 | 10/2007 |
| WO | WO 01/26526 | A1 | 4/2001 |
| WO | WO 2007/033979 | A1 | 3/2007 |

* cited by examiner

*Primary Examiner* — Duane Smith
*Assistant Examiner* — Minh-Chau Pham
(74) *Attorney, Agent, or Firm* — Brinks Hofer Gilson & Lione

(57) ABSTRACT

A holding plate for a vacuum cleaner bag is provided. The holding plate includes a base plate with an opening, a closing element pivotably arranged on the base plate, and a spring element having a bending angle (B) that upon pivoting of the closing element in an opening direction from a first position to a second position in which the opening is opened, in a predetermined pivoting angle range that is smaller than the corresponding opening angle (* α) of the closing element, wherein the closing element can be brought from the second position into the first position by the restoring force of the spring element in the direction opposite to the opening direction, and wherein the spring element is located behind the locking element in the opening direction.

24 Claims, 2 Drawing Sheets

HOLDING PLATE FOR A VACUUM CLEANER FILTER BAG

This application claims the benefit under 35 U.S.C. §371 of International Application No. PCT/EP2007/003558, filed Apr. 23, 2007, which claims the benefit of European Application No. 06008560.2, filed Apr. 25, 2006, and German Application No. 10 2007 004 329.7, filed Jan. 29, 2007. These references are incorporated herein in their entirety.

FIELD OF THE INVENTION

The present invention relates to a holding plate for a vacuum cleaner filter bag and to a vacuum cleaner filter bag comprising such a holding plate.

BACKGROUND

Vacuum cleaner filter bags are arranged in the interior of the housing of a vacuum cleaner to collect the aspirated dust. To fasten the vacuum cleaner filter bag in the interior of the housing, vacuum cleaner filter bags comprise a corresponding holding plate via which the vacuum cleaner filter bag can be fixed on a holding device provided in the interior of the housing.

Such holding plates comprise a through opening through which an air stream with dust particles can enter into the interior of the filter bag. It is desired for various reasons that this through opening can be closed. On the one hand, when a filled vacuum cleaner filter bag is disposed off, a closed through-opening can prevent dust that has accumulated in the filter bag from exiting. Furthermore, some vacuum cleaner filter bags comprise loose particles, e.g. for odor absorption. To prevent such particles from falling out of the bag, it is also of advantage when the through opening is closed.

Such a holding plate with a through opening that can be closed by means of a closing element is known from WO 01/26526. In this holding plate a leaf spring cooperates with the closing element, and the spring characteristic is here chosen such that starting from a closing position the bending force first increases considerably and then drops almost suddenly to a minimum to rise again thereafter. The drawback of this holding plate is that the bending force rises relatively strongly in the case of large opening angles. A complete opening of the through opening, which during operation must be accomplished through the vacuum stream of the vacuum cleaner, is thereby rendered difficult.

A further holding plate is known from DE 102 09 718. In this holding plate a spring element for a closing flap is configured as a tension spring mounted on the side of the closing flap on which it is tension-loaded when the closing flap is opened. The drawback is here that during operation of the vacuum cleaner this spring element is always positioned in the flow path of the air flow, whereby dirt is collecting on the spring. Such dirt, which is often in the form of fibers, impairs the function of the spring and the closing function of the flap. Moreover, the tension spring is prone to high wear caused by impinging dirt particles.

A further holding plate with a closing flap and a tension spring is described in DE 44 15 350.

BRIEF SUMMARY OF THE INVENTION

In the light of this prior art, it is therefore the object of the present invention to provide a holding plate for a vacuum cleaner filter bag which provides for an improved opening and closing mechanism.

The present invention provides for a holding plate for a vacuum cleaner filter bag comprising a base plate with a through opening, a closing element pivotably arranged on the base plate for closing the through opening, and a spring element arranged such that the bending angle of the spring element upon pivoting of the closing element in an opening direction from a first position, in which the through opening is closed, into a second position, in which the through opening is opened, in a predetermined pivoting angle range is smaller than the corresponding opening angle of the closing element, the closing element can be brought by a restoring force of the spring element in a direction opposite the opening direction from the second position into the first position, and the spring element is arranged behind the closing element in the opening direction.

With such an arrangement of the spring element in the case of which the bending angle in a predetermined pivoting angle range during opening of the through opening by pivoting the closing element is smaller than the corresponding opening angle of the closing element, a situation is achieved where the bending force needed during pivoting of the closing element for overcoming the restoring force of the spring rises to a relatively weak degree. This permits a reliable and wide opening of the through opening even in the case of weak vacuum streams.

The opening angle is the angle by which the closing element is pivoted from the first position into the second position. The bending angle is the angle by which the spring element is bent during pivoting of the closing element from the first position into the second position. With a closed through opening the opening angle is zero; the initial bending angle will then also assume a fixed value which is e.g. zero or small (depending on the bias). Starting from this initial bending angle, it is then determined by which bending angle the spring element is bent upon pivoting of the closing element, i.e. the bending angle is the angle value which follows from the difference from the final bending angle in the second position and from the initial bending angle.

The opening direction is the direction in which the closing element is pivoted from the first position, in which the through opening is closed, into a second position, in which the through opening is opened. Thus the spring element is here arranged in air flow direction behind the closing element.

The spring element arranged behind the closing element has the advantage that the spring element is not arranged in the flow path in the opened state of the through opening.

The bending angle can be smaller than the opening angle particularly over the whole opening angle range and the whole pivoting angle range. As an alternative, the bending angle can be smaller than the opening angle for opening angles greater than 10°, particularly greater than 20°. Furthermore, the bending angle can be smaller than the opening angle for opening angles of less than 90°, particularly less than 80°, particularly less than 70°.

The bending angle of the spring element upon pivoting of the closing element in the opening direction from the first position into a second position can be in the predetermined pivoting angle range 10% smaller, particularly 20% smaller, preferably 30% smaller, more preferably 40% smaller, most preferably 50% smaller than the opening angle of the closing element.

The spring element is preferably configured and/or arranged such that it can be brought by a vacuum stream from the first position into the second position and/or in response to a vacuum stream from the second position into the first position.

The closing element or the base plate may comprise a hole and the spring element may be arranged such that one end of the spring element will engage into a hole upon pivoting of the closing element in opening direction. When the spring element is a leaf spring, the end may particularly be a longitudinal end of the leaf spring.

It is advantageously accomplished through this engagement into the hole that the bending angle of the spring element upon pivoting of the closing element in opening direction is smaller than the opening angle of the closing element.

The hole may be a through hole or a blind hole. The blind hole in the closing element particularly shows the advantage that the air stream path in the opened state of the through opening is obstructed just insignificantly. The blind hole can be obtained by way of a hollow in the base plate or the closing element or by covering or closing a through hole.

The hole may e.g. be a blind hole the bottom of which is made deformable. For instance, the bottom may be formed by a nonwoven fabric; such a nonwoven fabric may e.g. be glued or welded to the closing element or the base plate. A through hole is thereby covered by the nonwoven fabric. To maintain the deformable state, the nonwoven fabric may particularly comprise an area larger than the base area of the hole, so that it is not stretched over the hole.

The hole may be a blind hole the bottom of which includes an elastic material and/or a foil, particularly an elastic foil. When the one end of the spring element upon pivoting of the closing element engages into the hole and reaches the bottom, an elastic material advantageously permits a further pivoting of the closing element, in which process the bottom of the hole, namely the elastic material, is then deformed by being acted upon with the end of the spring element. The spring characteristic can thereby be influenced in addition. The foil may particularly be designed as an air-impermeable foil and/or comprise a thermoplastic elastomer. As an alternative, the bottom may also comprise a stiff material.

At one end the spring element may be fixedly connected to the base plate or the closing element and may movably rest on the closing element or the base plate at the other end. For instance when the closing element comprises a hole, particularly a blind hole or a hollow, the spring element may be fixedly connected at the one end to the base plate and movably rest on the closing element. Upon pivoting of the closing element out of the first position into a second position, the support area of the closing element will then be moved along the spring element, so that the end of the spring element engages into the hole.

The spring element may be connected to the closing element or the base plate in a non-positive, positive or adhesive way. The connection may particularly be a clamping connection, a welding connection or an adhesive connection.

The spring element may be a bending spring, a flat spring, a leaf spring, particularly a cambered leaf spring, a torsion spring, or a form spring. For instance, a cambered leaf spring, i.e. a leaf spring with a continuous curvature in a direction transverse to the longitudinal axis, yields a high pressing force already in the case of thin springs.

The spring element can be movably arranged on the closing element or the base plate and cooperate with the closing element or the base plate such that the spring characteristic upon pivoting of the closing element in a predetermined pivoting angle range is substantially linear or degressive.

A degressive spring characteristic is understood to be a characteristic in the case of which the spring force or bending force applied via the closing element shows, in response to the opening angle or pivoting angle, a derivative decreasing with a growing opening angle. The amount of the spring force or the bending force corresponds to the amount of the restoring force acting on the closing element at the corresponding opening angle. This derivative is constant in the case of a linear spring characteristic.

The closing element or the base plate can comprise a support area on which the spring element is movably positioned in a contact area of the spring element.

To be more specific, the support area and/or the contact area may be configured such that the spring characteristic upon pivoting of the closing element in a predetermined pivoting angle range is substantially linear or degressive.

Thus, a substantially constant or degressive spring characteristic can be chosen especially for large opening angles, which simplifies a further opening at these opening angles. With large opening angles it is enough when the necessary bending force for a specific pivoting angle is small as long as the bending force is adequately large in the case of small opening angles so as to close the through opening in a safe way when the closing element in the first position is not acted upon with a force via a vacuum stream.

In the previously described holding plates the closing element or the base plate may comprise a support area on which the spring element movably rests in a contact area of the spring element, the support area upon pivoting of the closing element in the opening direction being movable along the contact area in such fashion that the bending angle in the predetermined pivoting angle range is smaller than the corresponding opening angle. Especially when the spring element is firmly connected to the base plate, the closing element may comprise the support area.

The spring element may comprise a recess or a hollow in the contact area. This yields a suitable spring characteristic in a simple way. Upon pivoting of the closing element in the opening direction along the contact area one will obtain a degressive curve of the characteristic as soon as the support area reaches the recess or hollow.

The previously described support areas may be configured in the form of an elevation. With such an elevation it is possible to precisely select the cooperation of closing element or base plate and spring element, especially the corresponding support of the spring element. Furthermore, when such an elevation upon pivoting of the closing element engages into a recess or hollow of the spring element, this will lead to a degressive behavior of the spring characteristic.

Moreover, with an appropriate design of the elevation, the demand for a bending angle smaller than the opening angle in a predetermined pivoting angle range can be met without the closing element or the base plate having a hole into which an end of the spring element engages.

The closing element may have an area, particularly a planar area, which at the side that is the front one in the opening direction comprises a collar at least in part.

Such a collar, i.e. an elevation surrounding the area of the closing element at least in part, increases the contact area for an air stream during operation of the holding plate, which makes it easier to open the through opening by pivoting the closing element.

In the previously described holding plates, the base plate and/or the closing element may comprise a plastic material or cardboard.

To be more specific, base plate and closing element may be made integral, and the closing element may be connected via a fold line or a film hinge to the base plate, with a pivot axis being formed by the fold line or the film hinge.

Hence, one of the above-described holding plates can be manufactured in a particularly simple way.

The spring element of the previously described holding plates may comprise a metal or a plastic material; it may particularly comprise a spring steel, a thermosetting material or an elastomer, particularly a thermoplastic elastomer. The spring element may particularly be a bending spring of spring steel, a thermosetting material or an elastomer.

The previously described holding plates may comprise a sealing element. Such a sealing element serves to seal the through opening when a pipe nozzle engages into the through opening during operation. The sealing element may particularly be arranged on the base plate while surrounding the through opening. For instance the sealing element may be shaped in the form of a ring.

The sealing element may be arranged in the opening direction of the closing element in front of the closing element on the base plate and project into the through opening. Due to such projection the sealing element protrudes beyond the rim of the through opening and can thereby sealingly contact a pipe nozzle inserted into the through opening. The sealing element may particularly comprise a thermoplastic elastomer (TPE). The sealing element can thereby be produced in an easy way and connected to the base plate. Furthermore, an elastic sealing element is thereby obtained that can be deformed by a pipe nozzle.

The width of the sealing element area projecting into the through opening may be not more than 120% of the distance between the sealing element and the closing element. For determining this distance the first position of the closing element in which the through opening is closed is of relevance. Width of the area projecting into the through opening is here understood to be the distance between the edge of the through opening on which the sealing element is arranged, and the inner rim of the sealing element. With a varying distance between edge and inner rim the maximum distance shall be meant. With a ring-shaped sealing element and a circular through-opening, particularly the area projecting into the through opening may also be in the form of a circular ring; the width is then the ring width of the sealing element part that is positioned in the through opening and shaped in the form of a circular ring. The sealing element, however, need not be configured in the form of a circular ring. To be more specific, the inner rim of the sealing element may also have the shape of a circle or also another shape. Particularly the sealing element and/or the closing element may be configured and/or arranged such that the sealing element is spaced apart from the closing element; hence, the sealing element does not contact the closing element, particularly also not in its first position.

To be more specific, the width may be not more than 110% of the distance between the sealing element and the closing element. Particularly preferably the width may be equal to or greater or smaller than the distance between the sealing element and the closing element. This is to achieve a situation where the sealing element even upon deformation by an introduced pipe nozzle will not reach the closing element and impede the closing thereof. Depending on the size (particularly the diameter) of the pipe nozzle and the immersion angle into the through opening, it may be enough when the width of the sealing element area projecting into the through opening is 120% of the distance between the sealing element and the closing element.

Furthermore, the invention provides a vacuum cleaner filter bag comprising one of the above-described holding plates.

BRIEF DESCRIPTION OF THE DRAWINGS

Further advantages and features of the invention shall now be explained by way of example with reference to the figures.

DETAILED DESCRIPTION

Figure 1:
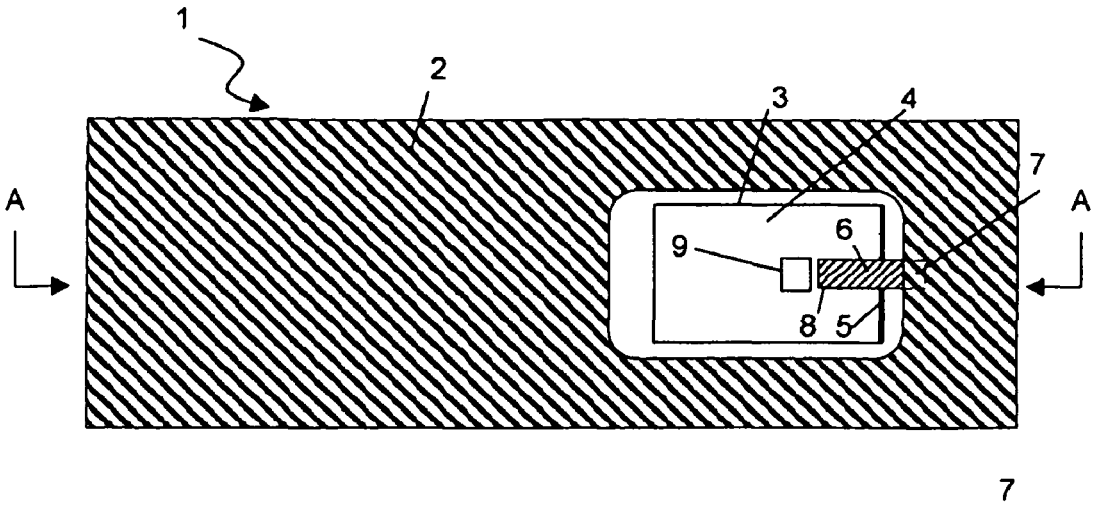
FIG. 1 is a top view on a holding plate according to the invention with a closed through opening.

FIG. 1 is a schematic top view (in a direction opposite the opening direction) on a holding plate 1 according to the invention. Said holding plate 1 comprises a base plate 2, which is for instance provided in the form of an injection-molded part made from a plastic material. The base plate 2 has formed therein a through opening 3 which in the illustrated example is closed by a closing element or a closing cap 4. Closing element 4 and base plate 2 are made integral as an injection-molded part, the closing element 4 being connected to the base plate 2 via a film hinge 5, by which a pivot axis is formed.

Furthermore, a spring element 6 is provided in the form of a leaf spring to hold the closing element 4 in the illustrated first position, the closing position. One longitudinal end 7 of the leaf spring 6 is firmly connected to the base plate 2 by being embedded in the plastic material. The other longitudinal end 8 is movably positioned on the closing element 4. The leaf spring 6 is arranged in opening direction behind the closing element 4, whereas it is positioned in the illustrated top view in a direction opposite the opening direction in front of the closing element 4.

The leaf spring may e.g. be made of spring steel, a thermosetting material or a thermoplastic elastomer. The leaf spring may be connected to the base plate for instance by means of a clamp-connection. This can e.g. be accomplished in a base plate of plastics in that an end of the leaf spring is arranged between two plastic layers, which are then welded together. As an alternative, the leaf spring may also be glued to the base plate or connected by welding.

Furthermore, the closing element 4 has formed therein a hole 9 into which the leaf spring 6 will engage upon pivoting of the closing element 4 in opening direction. The leaf spring 6 is cambered, i.e., it shows a continuous curvature in a direction transverse to the longitudinal axis. Due to this curvature the leaf spring 6 contacts the surface of the closing element 4 only on its longitudinally extending side edges.

Figure 2:
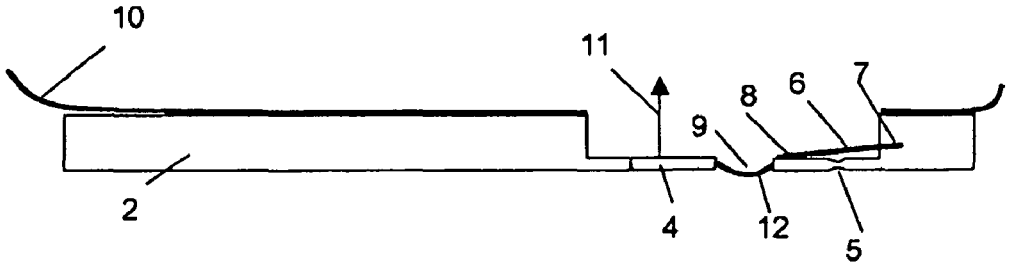
FIG. 2 is a cross-sectional view of the holding plate of FIG. 1.

FIG. 2 is a schematic cross-sectional view through the holding plate of FIG. 1 along line A-A, which extends along one of the longitudinal axes of the leaf spring 6.

As can be seen from this cross-sectional view, the one longitudinal end 7 of the leaf spring 6 is embedded in the plastic material of the base plate 2 and thus fixed. The other longitudinal end 8 contacts the closing element 4 in the area of the side edges of the leaf spring (the contact area), so that with an appropriately selected bias of the leaf spring the closing element is held by the restoring force of the spring in the illustrated first position or closing position.

The holding plate 1 is connected to the bag wall 10 of a vacuum cleaner filter bag, for instance by gluing. As an alternative, the bag wall may also comprise fastening elements fixedly connected thereto, which elements may then have connected thereto a holding plate in a detachable way without destruction, so that such a holding plate can be used repeatedly. The bag wall may have a filter structure, as is e.g. described in EP 0 960 645.

In the illustrated example the hole 9 is a blind hole the bottom 12 of which is formed by an elastic foil. Such an elastic cover of the hole 9 can be accomplished in that a TPE (thermoplastic polymer) is injected in the two-component method onto this area of the closing element. Such a bottom prevents a situation where dirt exits through the hole out of the interior of the bag.

During operation of the vacuum cleaner filter bag in a vacuum cleaner housing the closing element 4 is acted upon by a vacuum stream with a force acting against the restoring force of the leaf spring 6. When the force of the vacuum stream exceeds the restoring force of the leaf spring, the closing element will be pivoted in opening direction 11, see FIG. 2, and thus in the direction of the interior of the filter bag about the pivot axis formed by the film hinge 5.

Due to this pivotal movement the contact area of the closing element 2 moves along the side edges of the leaf spring 6 in the direction of the clamped longitudinal end 7. This has the effect that the other longitudinal end 8 engages into the hole 9 provided in the closing element. Due to this engagement the bending angle β of the leaf spring 6 is smaller than the opening angle α of the closing element. The bending force needed for pivoting the closing element 4 is thereby kept small so that the through opening 3 can also be opened in a safe way in the case of a weak vacuum stream.

With an appropriately deep penetration of the leaf spring 6 into the hole 9 the spring reaches the bottom 12 in the form of a foil which will be deformed upon further pivoting in opening direction. Thus the spring characteristic can additionally be modified by the elastic bottom.

As an alternative to the illustrated example the blind hole may also be formed by a hollow in the closing element, so that the bottom in the case of a stiff plastic material is made non-elastic. Instead of this, the hole 9 may also be a through hole.

Figure 4:
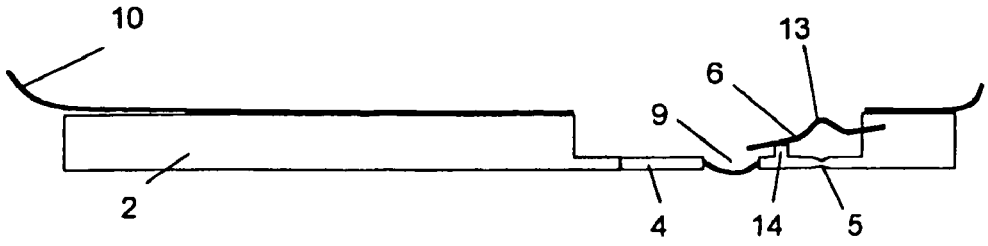
FIG. 4 is a cross-sectional view of an alternative embodiment of a holding plate according to the invention.

FIG. 4 is a schematic cross-sectional view of an alternative embodiment of a holding plate. The cross-sectional view of FIG. 4 is taken along the longitudinal axis of the leaf spring 6. In this instance, too, the leaf spring 6 is cambered, but additionally comprises a hollow 13 in the longitudinal direction. Furthermore, in the illustrated example the leaf spring 6 is not directly positioned with its side edges on the planar surface of the closing element 4. Instead of this an elevation is provided on the planar surface of the closing element 4 in the form of a pin 14 by which the support area of the closing element 4 is formed for the contact area of the leaf spring 6.

When the closing element 4 is pivoted in opening direction, pin 14 will move along the longitudinal axis of the leaf spring in the direction of the clamped longitudinal end 7. As soon as pin 14 has reached the hollow 13 of the leaf spring, the spring characteristic becomes degressive due to the arrangement of leaf spring and pin, so that starting from this opening angle of the closing element 4 the force to be further applied for pivoting the closing element 4 gets smaller.

It goes without saying that in this instance, too, the leaf spring need not be cambered and/or need not comprise an elevation and, as an alternative, it may e.g. also consist of a plastic material, such as a thermosetting material or TPE. Furthermore, the effect according to the invention with respect to the ratio of bending angle and opening angle can also be achieved in that the height of the elevation is chosen to be sufficiently large so that no hole is needed.

Figure 5:
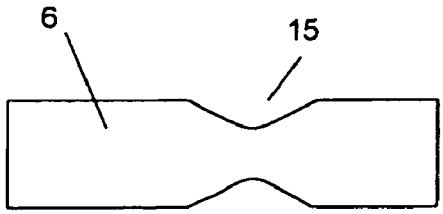
FIG. 5 is a top view on an embodiment of a leaf spring for a holding plate.

An alternative embodiment of a leaf spring 6 for use in a holding plate according to the invention is schematically shown in the top view of FIG. 5. The leaf spring is cambered and comprises recesses 15 at its two longitudinal sides in the curved wall.

Figure 3:
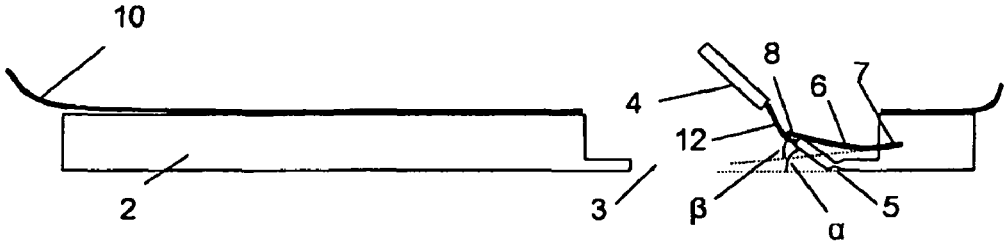
FIG. 3 is a cross-sectional view of a holding plate with an opened through-opening.

Such a leaf spring 6 can e.g. be used in the holding plates shown in FIGS. 1 to 3. In the closed state of the through opening the movable longitudinal end of the leaf spring is positioned at its side edges on the closing element. Upon pivoting of the closing element about the pivot axis the support area of the closing element will move along the leaf-spring contact area formed by the side edges of the leaf spring in the direction of the clamped longitudinal end, with the movable longitudinal end engaging into the blind hole provided in the closing element. As soon as the leaf spring engages with its recesses 15 into the blind hole of the closing element, the spring characteristic will also become degressive in this instance.

As an alternative to the embodiments shown in the figures, the leaf spring may also be fixed to the closing element and movably arranged on the base plate. In this case a hole into which the non-clamped longitudinal end of the leaf spring will engage upon pivoting of the closing element in the opening direction may e.g. be arranged in the base plate. As an alternative or in addition, the base plate may comprise an elevation on which an end of the leaf spring is movably positioned.

As a rule, other springs, such as torsion springs, form springs, or other types of bending springs, may be used instead of the leaf springs described in the embodiments.

Figure 6:
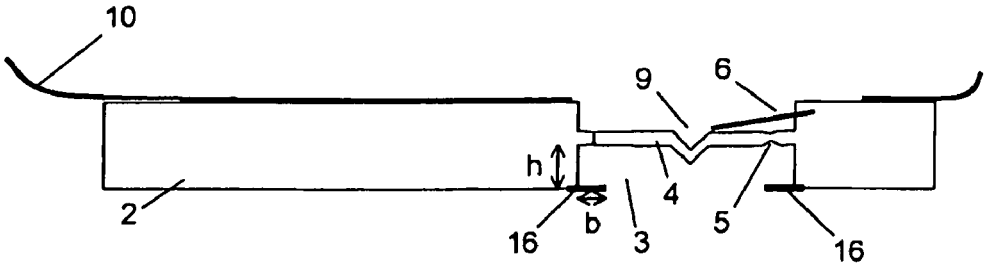
FIG. 6 is a cross-sectional view of a further embodiment of a holding plate according to the invention.

FIG. 6 is a schematic cross-sectional view through a further embodiment of a holding plate 1. The whole base plate 2 and the closing element 4 with the bottom of the blind hole 9 and the hollow, respectively, are here made from a plastic material. In this example an annular sealing element 16 is further provided surrounding the through opening 3. The sealing element may e.g. be made of TPE and injected onto the base plate. The width b of the sealing element 16 projecting into the through opening 3 is smaller than the distance h between sealing element 3 (or the corresponding edge of the through opening on which the sealing element is arranged) and closing element 4. This prevents a situation where the sealing element even upon deformation by a pipe nozzle engaging into the through opening 3 extends up to the closing element 4 and hinders its opening and closing.

It goes without saying that the above-described embodiments shall be understood by way of example and the illustrated and described features can also be combined with one another in a different way.

The invention claimed is:

1. A holding plate for a vacuum cleaner filter bag, comprising a base plate with a through opening, a closing element pivotably arranged on the base plate for closing the through opening, and a spring element comprising a bending angle (β) that upon pivoting of the closing element in an opening direction from a first position, in which the through opening is closed, into a second position, in which the through opening is opened, in a predetermined pivoting angle range is smaller than a corresponding opening angle (α) of the closing element, wherein the closing element can be brought by a restoring force of the spring element in a direction opposite the opening direction from the second position into the first position, and wherein the spring element is arranged behind the closing element in the opening direction.

2. The holding plate according to claim 1, wherein the closing element or the base plate comprises a hole and the spring element is arranged such that an end of the spring element upon pivoting of the closing element in opening direction engages into the hole.

3. The holding plate according to claim 2, wherein the hole is a through hole or a blind hole.

4. The holding plate according to claim 3, wherein the hole is a blind hole comprising a deformable blind hole bottom.

5. The holding plate according to claim 3, wherein the hole is a blind hole the having a bottom comprising an elastic material or a foil.

6. The holding plate according to claim 1, wherein the spring element is fixedly connected at one end to the base plate or the closing element and movably rests at the other end on the closing element or the base plate.

7. The holding plate according to claim 1, wherein the spring element is a bending spring, a flat spring, a leaf spring, a torsion spring or a form spring.

8. The holding plate according to claim 1, wherein the spring element is movably arranged on the closing element or the base plate and cooperates with the closing element or the base plate such that the spring characteristic upon pivoting of the closing element in a predetermined pivoting angle range is substantially linear or degressive.

9. The holding plate according to claim 1, wherein the closing element or the base plate comprises a support area on which the spring element movably rests in a contact area of the spring element.

10. The holding plate according to claim 9, wherein the support area or the contact area is configured such that the spring characteristic upon pivoting of the closing element in a predetermined pivoting angle range is substantially linear or degressive.

11. The holding plate according to claim 9, wherein the spring element in the contact area comprises a recess or a hollow.

12. The holding plate according to claim 9, wherein the support area comprises an elevation.

13. The holding plate according to claim 1, wherein the closing element comprises a collar on at least a portion of a front side of the closing element in the opening direction.

14. The holding plate according to claim 1, wherein the base plate or the closing element comprises a plastic material or cardboard.

15. The holding plate according to claim 14, wherein the base plate and the closing element are made integral and the closing element is connected via a fold line or a film hinge to the base plate, with a pivot axis being formed by the fold line or the film hinge.

16. The holding plate according to claim 1, wherein the spring element is a metal, or a plastic material.

17. The holding plate according to claim 1, comprising a sealing element which is arranged on the base plate while surrounding the through opening.

18. The holding plate according to claim 17, wherein the sealing element is arranged in the opening direction of the closing element in front of the closing element on the base plate and projects into the through opening.

19. The holding plate according to claim 18, wherein the width of the sealing element area projecting into the through opening is not more than 120% of the distance between the sealing element and the closing element.

20. A vacuum cleaner filter bag comprising a holding plate according to claim 1.

21. A holding plate for a vacuum cleaner filter bag, the holding plate comprising:

a base plate with a through opening, a closing element pivotably arranged on the base plate for closing the through opening, and a spring element;

wherein the closing element or the base plate comprises a support area on which the spring element movably rests in a contact area of the spring element, the support element comprising an elevation;

wherein the closing element can be brought by a restoring force of the spring element in a direction opposite an opening direction from a second position in which the through opening is opened, into a first position in which the through opening is closed, and wherein the spring element is arranged behind the closing element in the opening direction.

22. The holding plate according to claim 21, comprising a bending angle ($\beta$) that upon pivoting of the closing element in an opening direction from a first position, in which the through opening is closed, into a second position, in which the through opening is opened, in a predetermined pivoting angle range is smaller than a corresponding opening angle ($\alpha$) of the closing element.

23. The holding plate according to claim 21, wherein the closing element or the base plate comprises a hole and the spring element is arranged such that an end of the spring element upon pivoting of the closing element in the opening direction engages into the hole.

24. The holding plate according to claim 21, wherein the spring element is fixedly connected at one end to the base plate or the closing element and movably rests at the other end on the closing element or the base plate.

* * * * *